United States Patent [19]

Schmid

[11] 4,073,379

[45] Feb. 14, 1978

[54] BOWLING PIN ELEVATOR FOR A BOWLING INSTALLATION

[75] Inventor: August Schmid, Schwerzenbach, Switzerland

[73] Assignee: Patentverwertungs und Finanzierungsgesellschaft, Serania AG, Glarus, Switzerland

[21] Appl. No.: 728,159

[22] Filed: Sept. 30, 1976

Related U.S. Application Data

[63] Continuation-in-part of Ser. No. 589,267, June 23, 1975, abandoned.

[30] Foreign Application Priority Data

June 27, 1974 Switzerland ..... 8827/74

[51] Int. Cl.[2] ..... A63D 5/00

[52] U.S. Cl. ..... 198/796; 198/800; 273/43 E

[58] Field of Search ..... 198/706, 796, 800; 273/43 R, 43 A, 43 D, 43 E

[56] References Cited

U.S. PATENT DOCUMENTS

| | | | |
|---|---|---|---|
| 695,050 | 3/1902 | Hodges | 198/796 |
| 1,022,787 | 4/1912 | James | 198/796 |
| 1,197,146 | 9/1916 | Olson | 198/802 |
| 2,081,301 | 5/1937 | Hudspeth | 198/706 |
| 2,360,243 | 10/1944 | Lemmon | 198/629 |
| 2,743,927 | 5/1956 | Patterson | 198/476 |
| 3,004,759 | 10/1961 | Bond | 273/43 E |
| 3,239,221 | 3/1966 | Dowd et al. | 273/43 D |
| 3,435,942 | 4/1969 | Lehtola | 198/365 |
| 3,854,570 | 12/1974 | Kornylak | 198/800 |
| 3,966,206 | 6/1976 | Schmid | 273/43 E |

FOREIGN PATENT DOCUMENTS

| | | | |
|---|---|---|---|
| 553,669 | 3/1958 | Canada | 198/706 |
| 663,614 | 7/1938 | Germany | 198/796 |
| 1,098,274 | 1/1968 | United Kingdom | 198/796 |
| 918,011 | 2/1963 | United Kingdom | 273/43 E |

*Primary Examiner*—Evon C. Blunk
*Assistant Examiner*—Richard K. Thomson
*Attorney, Agent, or Firm*—Flynn & Frishauf

[57] ABSTRACT

Two vertically extending endless chains have bowling pin holders attached thereto to move the holders to a discharge region. The pin holders are pivotably supported on the chains and each of the holders has at least one projecting arm rigidly connected thereto. The arm is guided in a guide track to so position the bowling pin holders on the chains, when below the discharge region, that bowling pins are retained, the guide track deflecting the arm to permit the holder to pivot and release the pin thereon when at the discharge position.

10 Claims, 7 Drawing Figures

BOWLING PIN ELEVATOR FOR A BOWLING INSTALLATION

This application is a continuation-in-part of application Ser. No. 589,267 filed June 23, 1975, now abandoned.

CROSS REFERENCE TO RELATED PATENT

U.S. Pat. No. 3,966,206, July 1, 1976, August Schmid; assigned to the assignee of the present application.

The present invention relates to a bowling pin elevator for a bowling installation having a plurality of bowling pin holders attached to two endless chains.

It is the object of the present invention to create a bowling pin elevator which is as simple as possible and operationally safe, arranged to transport bowling pins from a bowling pin discharge region to a higher elevation and to discharge them therefrom.

SUBJECT MATTER OF THE PRESENT INVENTION

Bowling pin holders or baskets or containers are pivotably supported on upwardly extending chains. Each bowling pin holder has at least one rigid arm or extension fixedly secured thereto which abuts against guide means, preferably a channel track, to control the position of the respective bowling pin holder. Below the discharge region in a bowling installation, the guide means cause the holder to retain bowling pins therein; within the discharge region the guide means control tipping of the holder by pivoting of the arms and thus of the bowling pin holder.

The invention will be described by way of example with reference to the accompanying drawings, wherein.

Bowling pin elevators are used in bowling pin installations where the bowling pins are not suspended from cables, to elevate the bowling pins 3 from a lower, or receiving region, e.g. the pin pit, and subsequently to discharge them at a discharge region, at a predetermined height or level where the bowling pins 3 are then supplied to a bowling pin distributor or the like. The bowling pins are then handled, for example oriented in a predetermined axial direction, and set, by means not further described, onto a bowling pin alley in the right placement or disposition.

Figure 4:
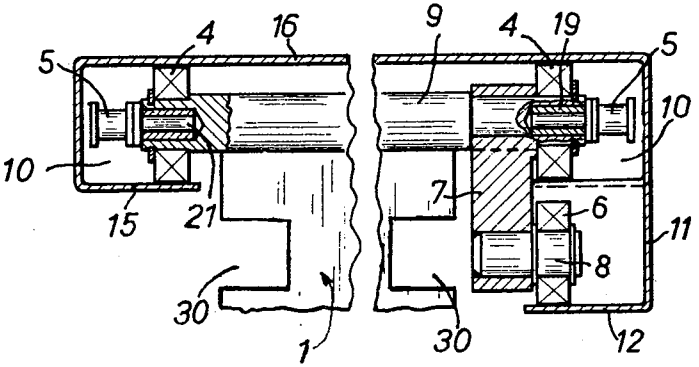
FIG. 4 is a section through the line IV—IV of FIG. 2.

The bowling pins 3 are picked up, when in lying-down, i.e. in flat position, by bowling pin holders 1 and elevated. Each bowling pin holder 1 is welded to a continuous horizontal rod 9, which is held on its respective ends by two spaced endless chains 5, only one of which is seen in the Figures. A plurality of bowling pin holders 1 are attached to the two chains 5 at regular intervals. Since all bowling pin holders 1 and their function are the same, only one of them will be described further in detail. Each bowling pin holder 1 has a V-shaped or concave, bowed cross section and is provided with an extension member pointing rearwardly. It may be made of metal, e.g. a metal casting, or plastic. As can be seen from FIG. 4, an axial pin which is rotatably supported in a respective bushing 19 provides rotatable connection between the rod 9 and the two chains. A roller 4 or a ball bearing is located on either end of rod 9. Rollers 4 are movable with relatively little play in respective tracks or channels. These tracks 10 are formed as a guide rail 15 made of sheet metal, a channel member or the like, and have a U-shaped horizontal cross section. A center piece 16 (FIG. 4) is disposed on the rear of the rail and connects the two ends of the rail. The chains 5 have clearance in axial direction relative to the rod 9 with respect to the U-shaped rail 15. A radially projecting arm 7 is connected to the rod 9 on at least one of its ends. A rotatable roller 6 or a ball bearing is located on a bolt 8 held on the arm 7 at the outer end thereof. The roller 6 has the same external diameter as the rollers 4, so that it is easily movable within the U-shaped rail 15.

Figure 2:
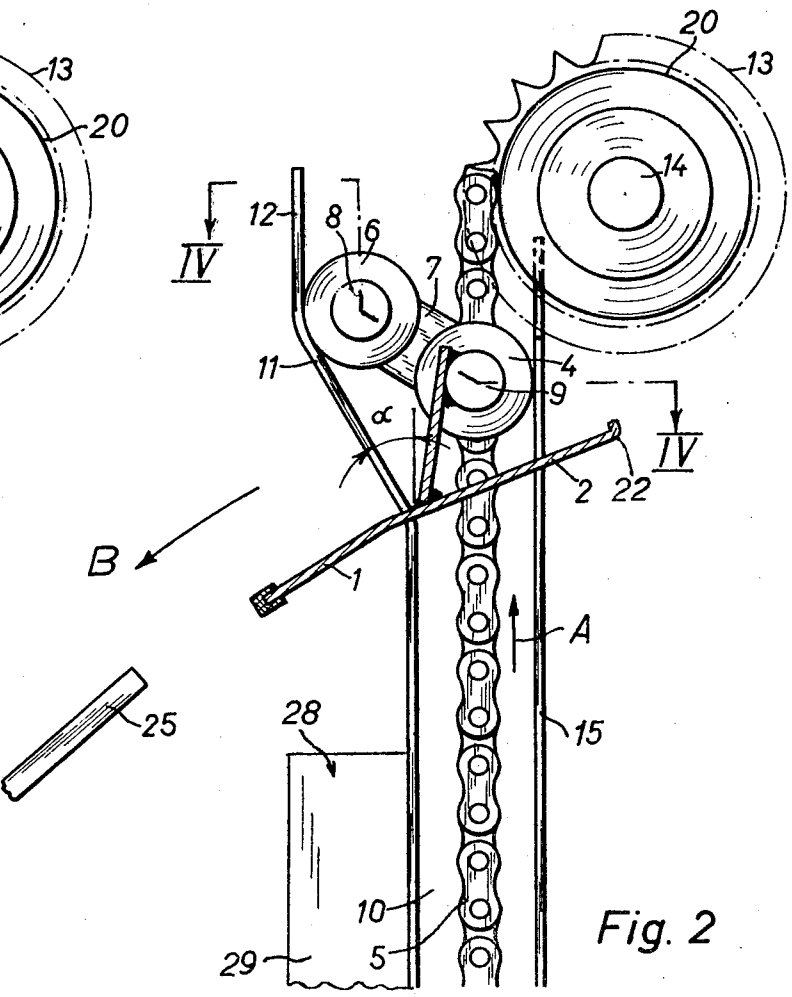
FIG. 2 is a view analogous to FIG. 1, the bowling pin holder being, however, in discharge position.
Figure 1:
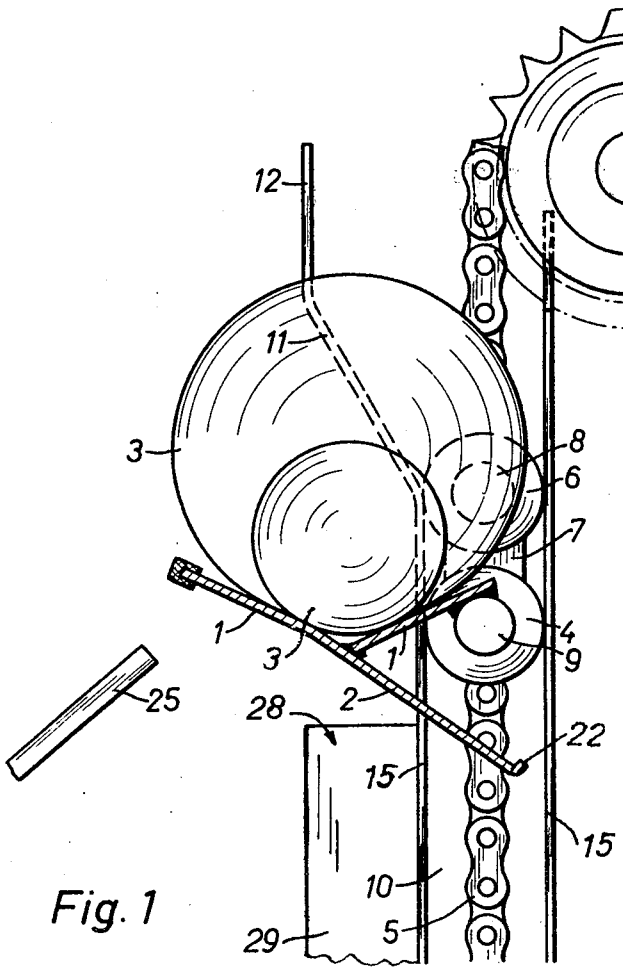
FIG. 1 is a schematic elevational view of a bowling pin elevator, the bowling pin holder being shown in vertical cross section, and loaded with a bowling pin.

Operation: During an upward movement of the bowling pin holders 1 below a bowling pin discharge region, the roller 6 is disposed vertically above the roller 4, as can be seen from FIG. 1. The channels 10 formed by the rail 15 are enlarged in the discharge region of the bowling pin holder 1 — i.e. close to the upper reversal region. The rail is formed with an inclined and upwardly pointing portion 11 and a substantially vertical portion 12 connected thereto. This results in an enlargement of the width of channel 10. The inclined portion 11 is inclined with respect to the vertical direction by an angle $\alpha$ of at least 25°, preferably about 30°. If the roller 6 now comes during an upward movement of the chains 5, i.e. in the direction of the arrow A, within the region of this enlargement of the recesses 10, the arm 7 is swivelled about this angle $\alpha$ due to the weight of the bowling pin holder 1 and a bowling pin 3 possibly contained thereon. Thus, the bowling pin holder 1 assumes the tilting position shown in FIG. 2, in which the bowling pin 3 is discharged in the direction of the arrow B. The discharged bowling pin 3 then falls or rolls off onto a chute or slide 25 or the like and is transported further therefrom.

Both chains 5 are guided above and below a pair of sprockets 13 and are reversed by them. The sprockets 13 are attached rigidly to a common shaft 14 which is driven by a drive wheel not further illustrated.

Figure 3:
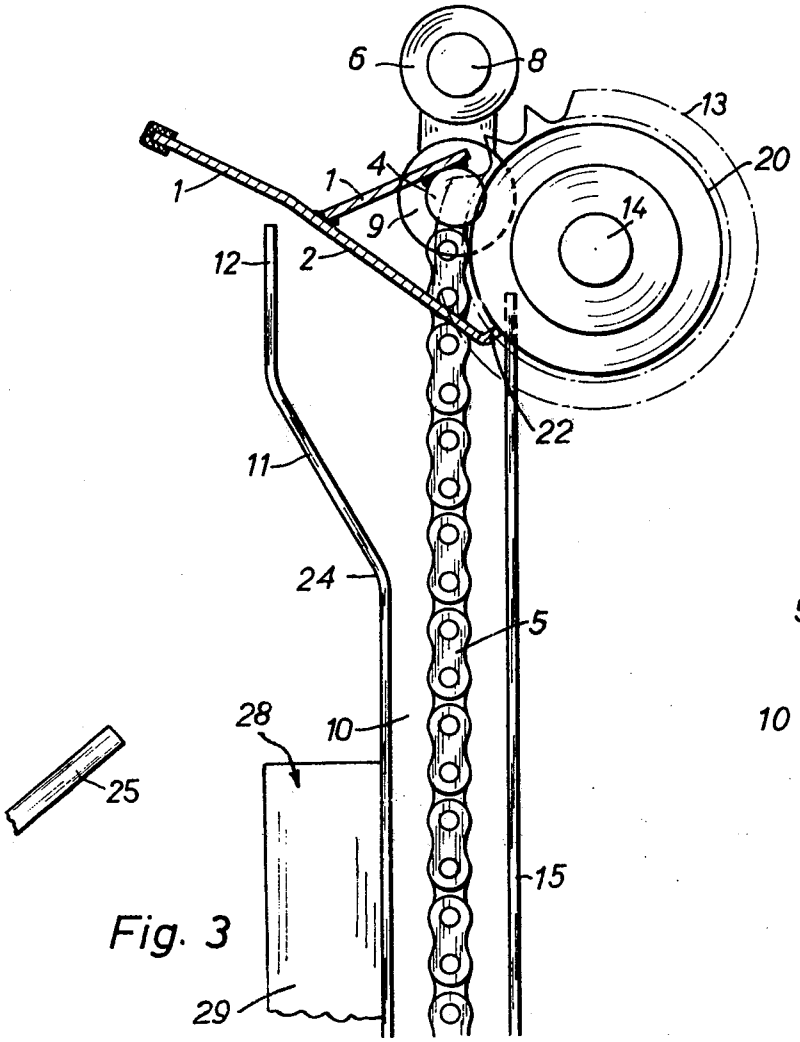
FIG. 3 is a view analogous to FIG. 1, the empty bowling pin holder being in the region of reversing of an upper reversing position.

FIG. 3 shows the position of the bowling pin holder 1 after discharge of the bowling pin 3 and upon the rod 9 coming within the region of the sprocket 13. An end rim 22 of an extension or supporting portion 2 of the bowling pin holder 1 engages a cylindrical roller 20 located between the sprockets 13 made of rubber or soft synthetic plastic, to guide holder 1 safely during its movement of the chain 5 over sprocket 13. The rollers 4 and 6 are then guided downwardly on their rear side in a second pair of rails not illustrated in the drawing.

Figure 5:
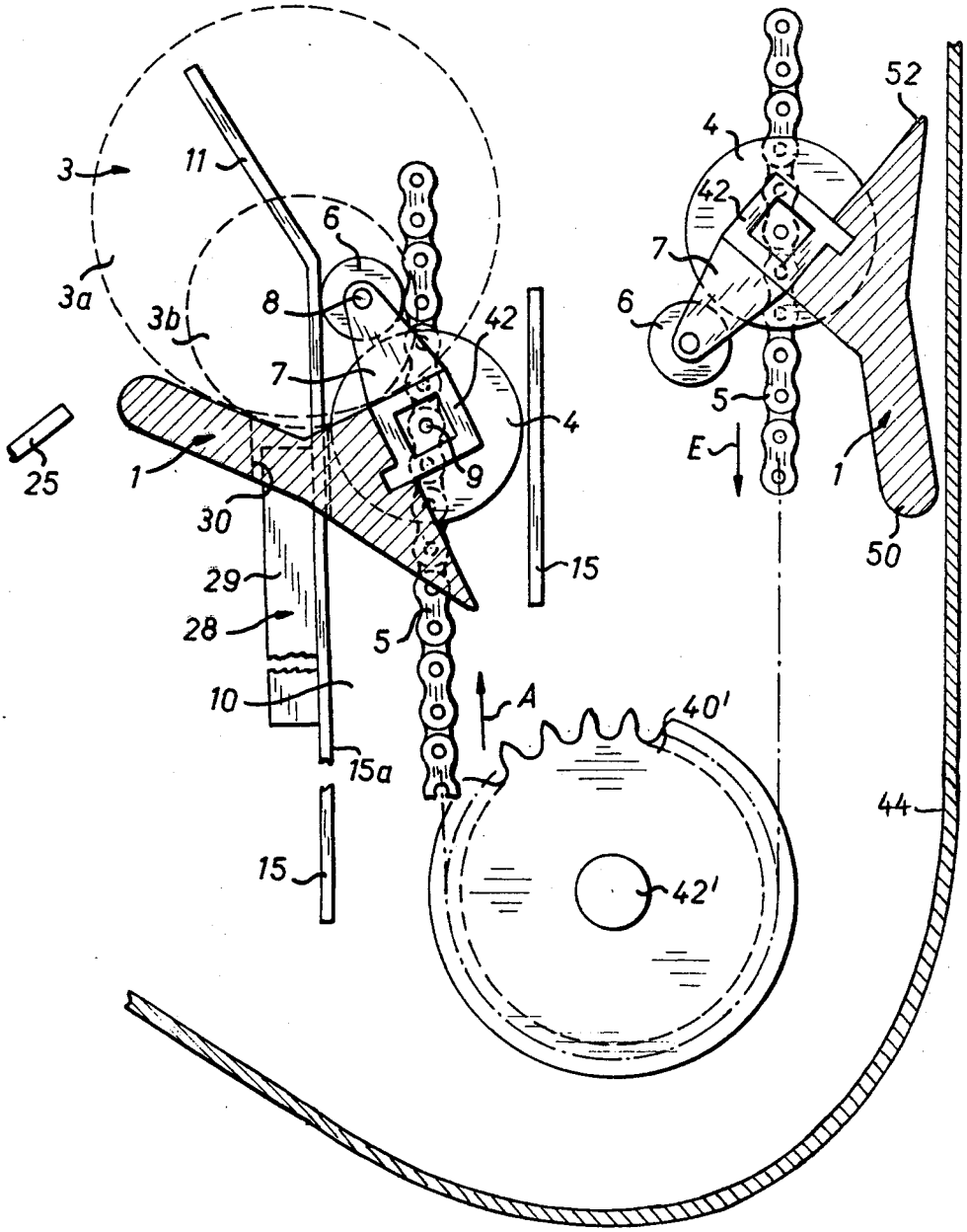
FIG. 5 is a schematic fragmentary cross-sectional view similar to FIG. 1, illustrating another embodiment of the invention.
Figure 6:
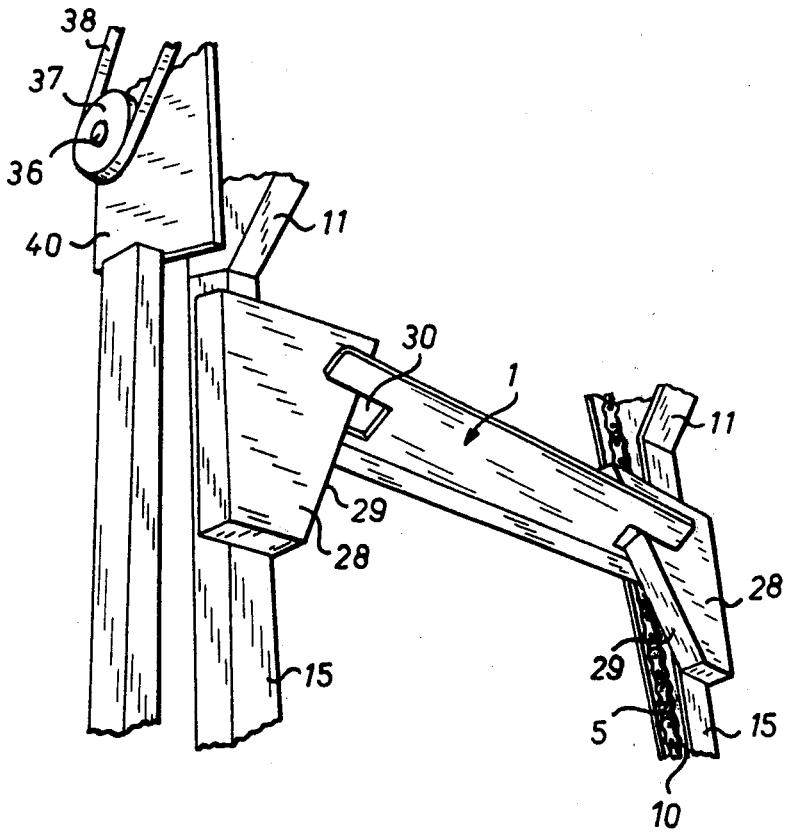
FIG. 6 is a fragmatic perspective view illustrating the bowling pin holder as it passes a pin centering arrangement.
Figure 7:
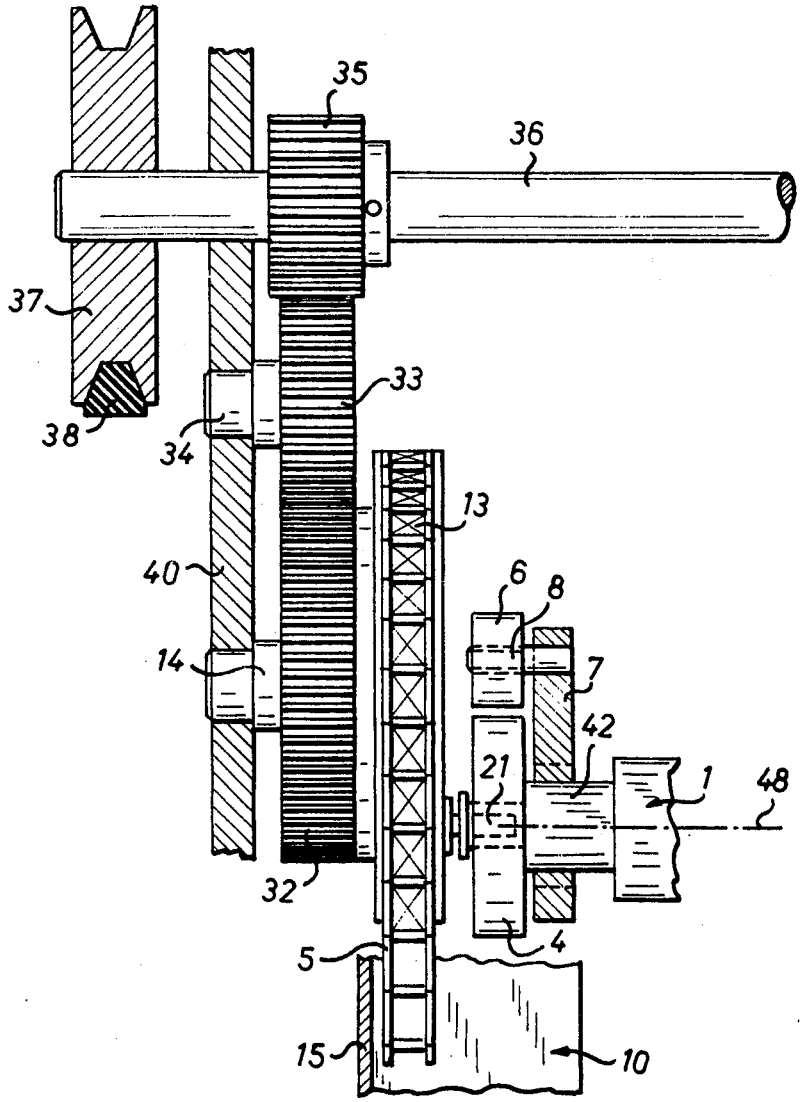
FIG. 7 is a fragmentary side view, partly in section, illustrating the upper sprocket, its drive, and the turnover mechanism for the bowling pin holders.

For reliable pick-up of bowling pins on the holders, it is desirable that the holders be somewhat wider than the pins. The pins should, however, be delivered with accurate positioning, for example to permit engagement of the pins by feelers to sense their respective axial endfor-end direction, attitude, or alignment. A centering arrangement is shown in FIGS. 5 to 7. Additionally, the construction of FIGS. 5 to 7 is so made that a particularly compact elevator system will result.

The basic difference between the embodiment of FIGS. 1-4 and of FIGS. 5 to 7 is the provision of lateral centering guide planes 29, 29 (FIG. 6) and the bearing arrangement for the sprocket wheels which are so attached to the frame of the machine that they are supported laterally from a side bearing at one side of the sprocket wheel only, synchronous drive of the sprocket wheels at opposite sides of the elevator to support the two ends of the pin pick-up holders being effected by a common shaft located above, or laterally, with respect to the sprockets themselves.

Parts which are similar or analogous to those previously described, have been given the same reference numerals, and their function will not be described again.

The holders 1 for the bowling pins 3 preferably are made of plastic, or a metal casting, preferably a lightweight metal casting. The bowling pins 3 are picked up by the holders 1 from the pin pit. The holders 1 are laterally longer than the axial length of the bowling pins; this substantially facilitates loading pins 3 into the holders 1. To provide for later, accurately predetermined relative positioning of the pins 3 on the holders 1, guide elements 28, 29 (FIGS. 5, 6) are located on the frame of the machine to center the bowling pins 3 on the holders 1 as the bowling pins 3 are moved upwardly by the moving holders. The centering elements 28 are preferably made of wood and are formed with inclined centering surfaces 29 which engage the head 3*b* of the bowling pin, or the bottom end thereof. The inclined surfaces 29 are so arranged that the relative distance, upwardly, decreases. The narrowest relative distance is slightly longer than the length of the pins 3, so that the pins 3 are moved in centered position on the holders 1 as they are being carried upwardly on the elevator mechanism. The holders 1 are formed with lateral slots 30 which are slightly larger than the centering blocks 28, the holders passing around the centering blocks (as best seen in FIG. 6) with some clearance. During the upward movement of chains 5, the bowling pin holders 1 hanging thereon surround the centering blocks 28 which pass through the respective slots 30, thus laterally or axially shifting such pins 3 as may be placed on the holders and which are not in centered position, until the particular predetermined position is reached. The position of the head 3*b* of the bowling pin and the body portion 3*a* thereof can then be sensed by feelers located in sensing alignment with the pin mechanism. A bowling pin orienting apparatus is shown in U.S. Pat. No. 3,966,206, by the inventor hereof, and assigned to the assignee of the present application. The centering blocks 28 are located along the lifting path of the bowling elevator and below the region in which the holders 1 begin to deflect to release the bowling pins therefrom. The bowling pin holders, with the slots 30 formed therein, thus leave the centering blocks 28 before they tip or pivot, that is, before they flip to permit the bowling pins to be ejected and handled at the higher level.

Two centering blocks are preferred, since the slopes of the centering surfaces 29 can be suitably selected to laterally shift bowling pins and permit wide holders; only one centering block need be provided, however, to slide the bowling pin against a stop formed on the holder itself, for example, or located on the frame of the elevator apparatus.

The upper sprocket wheel 13 of each one of the chains 5 is journalled only at one side thereof, for example by means of stub shaft 14'. Stub shaft 14' is, in turn, journalled in the side wall 40 of the elevator structure, or in a frame member thereof. The entire space between the two oppositely mounted sprocket wheels 13 is thus available for the width of the pin holders 1, so that the pin holders 1 can swing freely. Synchronous drive of the upper pair of sprocket wheels 13, located at opposite ends of the pin holders 1, is effected by an intermediate pinion 33, journalled on shaft 34 in the side wall 40 and driven, in turn, by a pinion 36 which is secured in driving relation to a shaft 36. Shaft 36, in turn, is driven from an outside drive source, for example by a pulley 37 engaged by a V-belt 38.

The two lower sprocket wheels 40' (FIG. 5) are constructed similarly to the upper sprockets 13; the respective shafts 42' are also journalled only at one side and do not extend through and across the apparatus.

The pin holders 1 are attached to a shaft 42 having approximately square cross section. The shafts 42 of the pin holders are attached to pins 21 projecting from the inside of the sprocket chain 5 (see FIG. 7). The shafts 42 are rotatable with respect to pins 21. The square shafts 42 have, at each end, the arm 7 attached thereto, the upper end of which has roller 6 journalled therein. Roller 6 can rotate about an axis 8 parallel to pin 21 (see FIG. 7). The pin holders 1 thus can tip about axis 48, aligned with pin 21. A roller 4 is located in the concave space 10 of U-shaped track 15. The interior surface of the track 15 and the outer surface of roller 4 are so dimensioned with respect to each other that there is some play between the track and the roller. The roller 4 is substantially larger than the small follower roller 6. The follower roller 6 is located, at the lifting run of the sprocket, above the roller 4. Rollers 4 and 6 operate in the same track along the guide track 15. Pin 21 and the axis of roller 4 are coaxial. Since the arm 7 and square shaft 42, and hence pin holder 1 are fixed with respect to each other, restrained against relative rotation, the position of the pin holder 1 will be determined by the position of the arm 7. During the upward movement in the direction of the arrow A (FIG. 2), the position of pin holder 1 will be as shown at the left side of FIG. 5. Roller 6 engages the forward inner surface 15*a* of the track 15. As soon as roller 6 reaches the inclined portion 11 of the track, roller 6 will escape and thus permit arm 7 to move and with it to tip the holder 1 to eject the pin 3, as explained in connection with FIGS. 1–4. The pin is then removed over an inclined slide 25. The inclined portion 11 of the track extends forwardly, that is, away from the return run of the sprocket chain. This arrangement permits a compact structure since the sprocket wheels can be very small.

When the pin holders 1 are in the region of the upper sprocket wheel pair 13 and have deflected, they will then follow the chain around the sprocket wheel. They will not, however, follow in the same sense, with respect to the sprocket wheel, but rather will retain the hanging position which they will have after release of the pin. This is seen at the right side of FIG. 5, which also shows the reverse run of the sprocket chain with a holder attached. After the pin 3 has been released, the holders 1 need pivot only over a very slight angle in order to reach the hanging position shown at the right side of FIG. 5. This further contributes to the compactness of the structure.

The return run of the sprocket chain 5 is shielded by a housing portion 44 which, at its lower end, is bowed and arranged for engagement by the leading edge 50 of the pin holders 1 or by an engaging extension thereof. The leading edge 50 then will slide along the bent portion of the wall 44 and, by movement thereof and consequent movement of edge 50 and roller 6, roller 6 will again be engaged in the track 15 as soon as upward movement commences. This ensures that the holders 1, when moving upwardly in the direction of arrow A, will have the proper position to accept bowling pins, although the pin holders 1 can rotate with respect to the chain 5. To prevent jamming of the rearward portion 52 of the bowling pin holder 1, the rearward portion can be made somewhat narrower than the forward, pick-up portion, and the wall 44 formed with an opening through which the tip of the rearward portion 52 can project.

Various changes and modifications may be made, and features described in connection with any one of the embodiments may be used with any of the others, within the scope of the inventive concept. Thus, as an example, the centering blocks 28 (FIG. 6) can equally be used in the embodiment of FIG. 1, and the reversal and ejection arrangement of FIGS. 1–4 can be used in the embodiment of FIGS. 5 to 7.

I claim:

1. Bowling pin elevator in a bowling pin installation, having bowling pin transport means to transport bowling pins to a discharge region, comprising two, each, upper and lower guide wheels (13, 40'), at least one of the guide wheels comprising a sprocket wheel (13);

two spaced upwardly extending endless chains (5) looped over the guide wheels (13, 40'), the guide wheels guiding the chains for endless travel and reversal;

a plurality of elongated bowling pin holders (1) attached to the endless chains (5), the chains moving the holders to the discharge region for the pins (1), said discharge region being located between the upper guide wheels (13);

means (9, 21) pivotably supporting the pin holders (1) on the chains (5);

at least one position control arm (7) fixedly secured to the pin holders (1) to control the pivotal position thereof;

guide track means (10) comprising upwardly directed generally U-shaped channels (15) guiding said pin holder position control arm (7) for holding the arm and hence the bowling pin holder (1) of the bowling pin transport means in a first pin supporting position when the holder is below the discharge region, said channels (15) retaining said chains (5) and being formed at the discharge region with a deflecting surface (11) extending away from the major direction of the channels (15) to guide the arm (7) for pivotal deflection when at the discharge region, and hence tip the bowling pin holder (1) to a pin discharge position;

a control arm guide roller (6) located above the pivot axis of the bowling pin holder (1) and secured to the pin holder position control arm (7), said control arm guide roller (6) and said means (9) pivotally supporting the pin holders on the chains (5) and said chains being retained in and guided by said U-shaped channels (15);

the channels (15), at the discharge region, having a width which is enlarged with respect to the remainder thereof to guide the control arm guide roller (6) away from the path of the chain and hence pivot the pin holder secured thereto, to pivotally deflect the pin holder and release a pin (3) supported by the pin holder, the enlarged width extending in a direction away from the return run of the chains (5) looped about the upper guide wheel (13), the arm (7) extending upwardly in the region of transport of pin holders (1) below the discharge position from the pivot axis (48) of the pin holder (1);

and centering means (28, 29) fixedly located adjacent the track means (10, 15) below the upper guide wheels (13), extending in a direction towards the center of the pin holders (1) to move a bowling pin (3) located on a respective holder (1) to a predetermined position, so that the pins (3) being discharged from the respective holders at the discharge position will have a predetermined position with respect to the track means (10, 15), the centering means comprising two centering structures (28) formed with converging surfaces (29) directed towards each other and, in the direction of movement of the pin holders (1), being inclined towards the center of the pin holder, the minimum distance of the inclined surfaces being slightly greater than the length of a pin (3) with which the elevator is to be used;

and clearance slots (30) formed in the pin holders and slightly greater than the wides dimension of the centering structures (28) to provide for passage of the pin holders (1) past the centering structures with clearance.

2. Elevator according to claim 1, further comprising a pin holder guide roller (4) located in and guided by said U-shaped channel (15), the arm (7) extending upwardly with respect to that roller and the guide roller (6) being located upwardly of the pin holder guide roller (4).

3. Elevator according to claim 1, wherein the upper and lower guide wheels (13, 40') comprise sprocket wheels;

stub shaft means (14', 42') journalling said sprocket wheels (13, 40') in the frame of the machine to leave a free space between said sprocket wheels;

the bowling pin holders (1) being pivoted on the chains (5) in off-center position, and offset in a direction to provide for pivoting of the fron portion (50) of the pin holders (10) downwardly when being carried by the downward run of the chains (5) and thus placing the control arm to extend downwardly from the pin holder (1);

and a reversal guide surface (44) located to be engaged by the front portion of the pin holders (1) and positioned in the region of the lower guide wheels (40') to guide the pin holders into a pick-up position and, upon being carried by the upwardly moving run of the sprocket, to then place the control arm (7) and the control arm guide roller (6) above the respective pin holder.

4. Elevator according to claim 1, wherein the centering means comprise centering blocks having a thickness less than the thickness of the pin holders (1), the blocks being formed with converging inclined surfaces (29).

5. Elevator according to claim 1, further comprising elastically surfaced cylindrical roller means (20) located adjacent the upper sprocket wheels (13) between said chains and coaxially therewith;

and a projecting arm (2) fixedly secured to said holders (1) extending from said holders (1) inwardly towards said roller means (20) to engage said roller means and to guide said holders by engagement with said roller means around the reversing movement commanded by engagement of the sprocket wheels (13) with the chains (5).

6. Bowling pin elevator in a bowling pin installation, having bowling pin transport means to transport bowling pins to a discharge region, comprising two, each, upper and lower guide wheels (13, 40'), at least one of the guide wheels comprising a sprocket wheel (13);

two spaced upwardly extending endless chains (5) looped over the guide wheels (13, 40'), the guide wheels guiding the chains for endless travel and reversal;

a plurality of elongated bowling pin holders (1) attached to the endless chains (5), the chains moving the holders to the discharge region for the pins (1), said discharge region being located between the upper guide wheels (13);

means (9, 21) pivotably supporting the pin holders (1) on the chains (5);

at least one position control arm (7) fixedly secured to the pin holders (1) to control the pivotal position thereof;

guide track means (10) comprising upwardly directed generally U-shaped channels (15) guiding said pin holder position control arm (7) for holding the arm and hence the bowling pin holder (1) of the bowling pin transport means in a first pin supporting position when the holder is below the discharge region, said channels (15) retaining said chains (5) and being formed at the discharge region with a deflecting surface (11) extending away from the major direction of the channels (15) to guide the arm (7) for pivotal deflection when at the discharge region, and hence tip the bowling pin holder (1) to a pin discharge position;

a control arm guide roller (6) located above the pivot axis of the bowling pin holders (1) secured to the pin holder position control arm (7), said control arm guide roller (6) and said means (9) pivotally supporting the pin holders on the chains (5) and said chains being retained in and guided by said U-shaped channels (15);

the channels (15), at the discharge region, having means (11, 12) to guide the control arm guide roller (6) away from the path of the chain and hence pivot the pin holder secured thereto, to privotally deflect the pin holder and release a pin (3) supported by the pin holder, said means extending in a direction away from the return run of the chains (5) looped about the upper guide wheel (13), the arm (7) extending upwardly in the region of transport of pin holders (1) below the discharge position from the pivot axis (48) of the pin holder (1);

said deflecting surface (11) extending forwardly of the upward run of the sprocket chain and away from the return downward run of the sprocket chain, the arms (7) of respective pin holders (1) in the upward run of the sprocket chain extending upwardly from the pivot axes (48) of the pin holders (1) when located below the pin discharge position;

stub shaft means (14, 42') journalling the upper and lower guide wheels (13, 40') at one respective side only of the guide wheels, the pin holders (1) being journalled on the sprocket chains such that their center of gravity is offset forwardly with respect to the sprocket chains when on the upward run of the sprocket chains so that, upon reaching the return or downward run of the sprocket chains, the pin holders (1) will pivot so that their forward portion (50) will extend downwardly and the arm (7) will extend downwardly;

and a reversal guide surface (44) engaging the forward portion (50) of the pin holders (1) in the region of the lower guide wheels (40') to reverse the position of the pin holders and place them into pick-up position to pick up further bowling pins and to place the guide arm (7) upwardly with respect to the pin holders when on the upward run of the sprocket chain.

7. Elevator according to claim 6, wherein the guide surface (44) comprises a sheet metal element engaging the forward portion (50) of the respective pin holders (1).

8. Bowling pin elevator in a bowling pin installation, having bowling pin transport means to transport bowling pins to a discharge region, comprising two, each, upper and lower guide wheels (13, 40'), at least one of the guide wheels comprising a sprocket wheel (13);

two spaced upwardly extending endless chains (5) looped over the guide wheels (13, 40'), the guide wheels guiding the chains for endless travel and reversal;

a plurality of elongated bowling pin holders (1) attached to the endless chains (5), the chains moving the holders to the discharge region for the pins (1), said discharge region being located between the upper guide wheels (13);

means (9, 21) pivotably supporting the pin holders (1) on the chains (5);

at least one position control arm (7) fixedly secured to the pin holders (1) to control the pivotal position thereof;

guide track means (10) comprising upwardly directed generally U-shaped channels (15) guiding said pin holder position control arm (7) for holding the arm and hence the bowling pin holder (1) of the bowling pin transport means in a first pin supporting position when the holder is below the discharge region, said channels (15) retaining said chains (5) and being formed at the discharge region with a deflecting surface (11) extending away from the major direction of the channels (15) to guide the arm (7) for pivotal deflection when at the discharge region, and hence tip the bowling pin holder (1) to a pin discharge position;

and centering means (28,29) fixedly located adjacent the track means (10,15) below the upper guide wheels (13), extending in a direction towards the center of the pin holders (1) to move a bowling pin (3) located on a respective holder (1) to a predetermined position, so that the pins (3) being discharged from the respective holders at the discharge position will have a predetermined position with respect to the track means (10,15), the centering means comprising two centering structures (28)

formed with converging surfaces (29) directed towards each other and, in the direction of movement of the pin holders (1) being inclined towards the center of the pin holder, the minimum distance of the inclined surfaces being slightly greater than the length of a pin (3) with which the elevator is to be used;

pin holder guide rollers (4) journalled on the pin holders (1) and located in and guided by said U-shaped channels (15), the arm (7) extending upwardly with respect to the pinholders guide rollers (4); and a control arm guide roller (6) secured to the control arm (7) and movable in said channels (15) located upwardly of the pin holder guide roller (4).

9. Elevator according to claim 8 wherein the upper and lower guide wheels (13, 40') comprise sprocket wheels;

stub shaft means (14', 42') journalling said sprocket wheels (13, 40') in the frame of the machine to leave a free space between said sprocket wheels;

the bowling pin holders (1) being pivoted on the chains (5) in off-center position, and offset in a direction to provide for pivoting of the fron portion (50) of the pin holders (10) downwardly when being carried by the downward run of the chains (5) and thus placing the control arm to extend downwardly from the pin holder (1);

and a reversal guide surface (44) located to be engaged by the front portion of the pin holders (1) and positioned in the region of the lower guide wheels (40') to guide the pin holders into a pick-up position and, upon being carried by the upwardly moving run of the sprocket, to then place the control arm (7) and the control arm guide roller (6) above the respective pin holder.

10. Elevator according to claim 8, wherein the centering means comprise centering blocks having a thickness less than the thickness of the pin holders (1), the blocks being formed with converging inclined surfaces (29)

and clearance slots (30) formed in the pin holders and slightly greater than the widest dimension of the blocks (28) to provide for passage of the pin holders (1) past the blocks, with clearance.

* * * * *